US012571070B2

(12) United States Patent
Galinho Henriques et al.

(10) Patent No.: US 12,571,070 B2
(45) Date of Patent: Mar. 10, 2026

(54) PROCESSES AND SYSTEMS OF RECOVERY OF RARE EARTH ELEMENTS AND/OR LITHIUM BY MARINE MACROALGAE

(71) Applicant: N9VE—NATURE, OCEAN AND VALUE, LDA, Oporto (PT)

(72) Inventors: Bruno Manuel Galinho Henriques, Vale de Estrela Guarda (PT); Maria Eduarda Da Cunha Pereira, Aveiro (PT); Jose Maria Pinto Basto Pinheiro Torres, Oporto (PT)

(73) Assignee: N9VE—NATURE, OCEAN AND VALUE, LDA, Oporto (PT)

( * ) Notice: Subject to any disclaimer, the term of this patent is extended or adjusted under 35 U.S.C. 154(b) by 833 days.

(21) Appl. No.: 17/681,938

(22) Filed: Feb. 28, 2022

(65) Prior Publication Data

US 2022/0178002 A1 Jun. 9, 2022

Related U.S. Application Data

(63) Continuation of application No. PCT/PT2020/000003, filed on Aug. 19, 2020.

(30) Foreign Application Priority Data

Aug. 28, 2019 (PT) ..... 115757

(51) Int. Cl.
*C22B 59/00* (2006.01)
*C22B 3/18* (2006.01)
*C22B 26/12* (2006.01)

(52) U.S. Cl.
CPC ..... *C22B 59/00* (2013.01); *C22B 3/18* (2013.01); *C22B 26/12* (2013.01)

(58) Field of Classification Search
CPC ..... C22B 59/00; C22B 26/12; C22B 7/006; C22B 11/042
See application file for complete search history.

(56) References Cited

U.S. PATENT DOCUMENTS 5,447,629 A 9/1995 Chaumont et al.
2012/0070351 A1 3/2012 Braconnier et al.
(Continued)

FOREIGN PATENT DOCUMENTS

CN 101279776 A 10/2008
CN 102395529 A 3/2012
(Continued)

OTHER PUBLICATIONS

E. Afonso,L. Carvalho, S. Fateixa, C. Amorim, V. Amaral, C. Vale, E. Pereira, C. Silva, T. Trindade, C. Lopes, Can contaminated waters or wastewater be alternative sources for technology-critical elements? The case of removal and recovery of lanthanides, Journal of Hazardous Materials 380(2019) 120845 (Year: 2019).*
(Continued)

*Primary Examiner* — Anthony M Liang
(74) *Attorney, Agent, or Firm* — McClure, Qualey & Rodack, LLP

(57) ABSTRACT

The present invention refers to processes and systems of recovery of rare earth elements and/or Lithium, from a certain type of primary salted medium such as a solid medium, such as muds, or such as an aqueous medium of high salinity, in particular from aqueous media with a pH greater than 6, and based upon certain types of living marine macroalgae.

11 Claims, 6 Drawing Sheets

(56) References Cited

U.S. PATENT DOCUMENTS

| | | | | |
|---|---|---|---|---|
| 2015/0104361 | A1 | 4/2015 | Boudreault et al. | |
| 2016/0068420 | A1* | 3/2016 | Rivasseau | B09C 1/002 435/257.1 |
| 2018/0195147 | A1 | 7/2018 | Jiao et al. | |

FOREIGN PATENT DOCUMENTS

| | | | |
|---|---|---|---|
| CN | 103827328 | A | 5/2014 |
| CN | 104603303 | A | 5/2015 |
| CN | 109161684 | A | 1/2019 |
| DE | 43 21 089 | A1 | 12/1994 |
| EP | 0 599 711 | A1 | 6/1994 |
| EP | 3 008 219 | B1 | 4/2016 |
| ES | 2 251 286 | A1 | 4/2006 |
| FR | 3 005 062 | A1 | 10/2014 |
| JP | S64-15133 | A | 1/1989 |
| JP | H02-83093 | A | 3/1990 |
| JP | H06-212309 | A | 8/1994 |
| JP | H09-98773 | A | 4/1997 |
| JP | 2013-001964 | A | 1/2013 |
| JP | 2017-008355 | A | 1/2017 |
| JP | 2017-061739 | A | 3/2017 |

OTHER PUBLICATIONS

Jessica Jacinto; Removal and recovery of Critical Rare Elements from contaminated waters by living Gracilaria gracilis; Oct. 27, 2017; Journal of Hazardous Materials; pp. 531-538 (Year: 2017).*

Chinese language office action dated Feb. 7, 2023, issued in application No. CN 202080069061.7.

English language translation of office action dated Feb. 7, 2023 (pp. 1-24 of attachment).

Jacinto, J., et al.; "Removal and recovery of Critical Rare Elements from contaminated waters by living Gracilaria gracilis;" Journal of Hazardous Materials; vol. 344; Oct. 2017; pp. 531-538.

Afonso, E.L., et al.; "Can contaminated waters or wastewater be alternative sources for technology-critical elements? The case of removal and recovery of lanthanides;" Journal of Hazardous Materials; vol. 380; Jul. 2019; pp. 1-10.

Chemodanov, A., et al.; "Design of marine macroalgae photobioreactor integrated into building to support seagriculture for biorefinery and bioeconomy;" Bioresource Technology; vol. 241; Jun. 2017; pp. 1084-1093.

International Search Report and Written Opinion issued in application No. PCT/PT2020/000003.

* cited by examiner

PROCESSES AND SYSTEMS OF RECOVERY OF RARE EARTH ELEMENTS AND/OR LITHIUM BY MARINE MACROALGAE

CROSS-REFERENCE TO RELATED APPLICATIONS

This application is a continuation of copending International Application No. PCT/PT2020/000003, filed Aug. 19, 2020, which is incorporated herein by reference in its entirety, and additionally claims priority from Portuguese Application No. PT115757, filed Aug. 28, 2019, which is also incorporated herein by reference in its entirety.

FIELD OF THE INVENTION

The present invention refers to the field of processes and systems of recovery of rare earth elements (REEs) and/or Lithium, and optionally of other elements, such as for example potentially toxic elements (PTEs), from a given primary medium, available as a solid medium, as muds or as an aqueous medium, such as for example industrial effluents or parts of aqueous streams, and based upon the use of certain types of algae, in particular certain living marine macroalgae.

BACKGROUND OF THE INVENTION

The increasing demand for several REEs for different applications in new technologies, the relative geographic limitation of their origin in quantities available for extraction, as well as the environmental impact caused by the extraction process, and the potential toxicological impact associated with their presence in effluents of industrial processes, have been driving an increasing interest on the possibility of recovering REEs from aqueous media in general, and from industrial effluents, in particular.

And, besides of said REEs, also Lithium has been assuming an increasing technological and economic relevance, whereby this metal can be frequently found in saline aqueous media, both at the sea as in industrial effluents.

Many saline aqueous media provide therefore an opportunity for recovering elements of economic value, whereby it is ever more important that such recovery can be attained without itself generating environmental impacts.

Moreover, the treatment of industrial effluents presently constitutes a problem for many industries because of the applicable regulations in terms of final disposal of said effluents, including the need for removal of several potentially toxic elements.

In this particular, there are known several solutions whereby the known technology also includes references to the use of algae and micro-organisms for separating rare earth elements from an aqueous medium.

The document JPS6415133 (A) discloses encapsulation of algae, such as green algae or brown algae, for recovery of noble metals, such as gold, silver and Platine. In particular, said algae are pulverized into fine particles that can pass through a mesh of 50.

The document JPH0283093 (A) discloses a method of purification of industrial effluents using chlorophyceae of the genre unicellular *chlamydomonas* for sorption of heavy metals, such as Cu, Ni or similar, from said industrial effluent.

The document JPH06212309 (A) discloses a method of separation of REEs based upon the use of a selective sorption by *spirulina* or *chlorella*, both microalgae, that can be added to a solution of ions of rare earth elements, whereby the sorption of these elements is maximal at a pH between 3 and 4.5.

The document JPH0998773 (A) discloses a new micro-organism that pertains to the genre metilo-bacterium and that is able of accumulating REEs.

The document JP2013001964 (A) discloses another method for recovering rare earth elements, in this case using iron reducing bacteria, advantageously the *shewanella* alga.

The document EP 3008219 B1 discloses a process of isolating one rare earth element: the scandium.

The document JP2017008355 (A) discloses another method of recovery of REEs based upon micro-organisms, and the document JP2017061739 (A) discloses a method that uses green alga of *scenedesmus*.

The document EP 0599711 A1 discloses a device for treatment of a liquid effluent with pollutants, notably metals and/or radionucleotids, by means of living cells of photosynthetic micro-organisms, such as for example Porphyridium cruentum.

Moreover, the document "Removal and recovery of Critical Rare Earth elements from contaminated waters by living *Gracilaria gracilis*", Jacinto J., Henriques B., et al, discusses the use of *Gracilaria gracilis* in the recovery of rare earth elements (ETRs) from liquid effluents.

However, this document does not disclose the optimal conditions for processing aqueous media, in an industrial process framework and considering several factors and parameters that are relevant for the operation of such a process and associated systems.

The document ES 2251286 A1 discloses a system of treatment of residual waters including filamentous green macroalgae of the genres Hydrodictyon or Cladophora, capable of absorbing and recycling nutrients and/or fixating/capturing heavy metals, and making specific reference to concentrations of copper and zinc.

The document DE 4321089 A1 discloses a process for selective decontamination of heavy metals from toxic media, in water, mud, sediments, or contaminated soil, contaminated with heavy metals, through the use of algae, whereby biomasses, alive or devitalized, obtained from marine macroalgae are treated and placed in contact with the toxic media.

None of the documents in the known technology discloses types of living macroalgae, quantities and further optimal operating parameters for recovering REEs and/or Lithium from aqueous effluents, notably of the industrial type. These aspects are determinant for an industrialization of processes of recovery of REEs and/or Lithium from aqueous media, in particular based upon macroalgae.

The objective of the present invention is to provide efficient and scalable processes and systems for recovery of rare earth elements (REEs) and/or Lithium from primary media, in particular from aqueous media associated with residues from industrial processes, including solid, liquid and mud-like effluents, or associated with aquifers, such as for example dams, water lines, sea shores or open sea.

SUMMARY

According to an embodiment, a process of recovery of rare earth elements (REEs) and/or Lithium from a primary medium may have the steps of:

providing an initial aqueous medium of the primary medium, presenting initial concentrations of at least one REEs and/or Lithium and a pH bigger than 6, to a first recovery disposition;

providing at least a first quantity of living marine macroalgae, optionally further at least a second quantity thereof, to the first recovery disposition so that can actively interact with the initial aqueous medium during a staging period of time;

after the staging period of time, obtaining an operative aqueous medium presenting current concentrations of at least one REEs and/or Lithium, smaller than the respective initial concentrations;

separating at least part of the quantity of living marine macroalgae from the operating aqueous medium;

processing the separated quantity of living marine macroalgae so as to obtain a secondary medium that includes quantities of REEs and/or Lithium at least similar to the respective quantities previously recovered by the living marine macroalgae from the aqueous medium.

According to another embodiment, a system for recovery of elements, including of rare earth elements (REEs) and/or Lithium, from a primary medium, in particular for carrying out the above inventive process, may be characterized for presenting:

a first recovery disposition adapted so that can collect a volume of aqueous medium, for example through a first connection, providing interaction thereof with a quantity of living marine macroalgae, and that can discharge said volume of fluid, for example through a second connection, supply means of a quantity of living marine macroalgae to said first recovery disposition, for example from a supply disposition, optionally, further a second recovery disposition provided in fluid connection with said first recovery disposition so that can carry out at least one of: collecting a fluid discharge therefrom, and supplying a fluid flow hereto;

advantageously, at least one supply disposition provided in optional fluid connection with said first recovery disposition and adapted so that can supply living marine macroalgae to the latter, optionally also collecting macroalgae therefrom;

preparation means of a secondary medium from said quantity of living marine macroalgae in one of two forms, including: in the form of a solution having REEs or in the form of ashes or chars having REEs;

optionally, further one other recovery disposition for collection of macroalgae and preparation of at least one of said forms of second medium from said marine macroalgae.

In particular, the aforementioned objective is solved by a process of recovery that includes an initial volume of an aqueous medium, optionally obtainable from a primary medium that is available as a solid, semi-solid or liquid medium, presenting initial concentrations of rare earth elements and/or Lithium, eventually further other elements, such as for example elements from the group of Platine, potentially toxic elements (PTEs), and providing at least a first quantity of living marine macroalgae to this aqueous medium.

It is of advantage when said quantity of living marine macroalgae can interact in active manner with said aqueous medium, including with the aid of forced circulation means of the aqueous medium, such as for example of the type rotating shovels, inducing closed trajectory circulation in a collecting disposition, and/or further of injection means of a gas volume, including of atmospheric gas or of carbon dioxide, into said aqueous medium.

Said process can be carried out in successive cycles of the type processing batch, during a staging period of time at a first disposition of recovery of the elements of interest.

Said process can be carried out based upon a quantity of living marine macroalgae and its periodic removal, for example daily, by a fraction thereof corresponding to the growth rate of the macroalga in the considered period.

Said process can include at least a first and a second successive recovery dispositions for collection of said aqueous medium, including respective steps of exposure to respective first and second quantities of living marine macroalgae, after which said aqueous medium can be supplied for example to a free running natural water line.

Said process can include the recirculation of a given volume of salted water, for example sea water, in closed circuit, in a plurality of operation cycles.

An associated objective is to provide a process that includes the separation of said rare earth elements and/or Lithium on said macroalgae, after a staging period of time and separation thereof from the aqueous medium.

This objective is solved according to the present invention by means of exposure of the living marine macroalgae, after separation thereof from said aqueous medium at the end of a staging period of time, to a dissolving agent so as to obtain a first solution including the quantities of REEs and/or Lithium recovered by the macroalgae.

Alternatively, the separation of REEs and/or Lithium can be realized by means of incineration, combustion or pyrolysis of the macroalgae so as to obtain the REEs and/or Lithium recovered by the macroalgae in the resulting ashes or chars.

The REEs obtained in the secondary medium can include at least one, advantageously a plurality from among the elements Lanthanum, Cerium, Praseodymium, Neodymium, Promethium, Samarium, Europium, Gadolinium, Terbium, Dysprosium, Holmium, Erbium, Thulium, Ytterbium, Lutetium, Scandium e Yttrium.

It is of advantage when the separation of the elements previously recovered from the saline aqueous medium by the living marine macroalgae, for example from a first solution provided thereform, besides of REEs and/or Lithium, further includes at least one of: at least one potentially toxic element (PTEs), and at least one element from the group of the Platine, such as for example Ruthenium, Palladium, Osmium, Iridium and Platine.

In the scope of the present invention, and according to the presently generally accepted definition, by potentially toxic elements one ought to understand a set of elements such as for example Antimony, Arsenic, Cadmium, Chromium, Copper, Lead, Mercury, Nickel, Selenium, Tellurium, Thallium, Tin, Cobalt, Manganese, Molybdenum, Vanadium, Strontium and Zinc.

An objective associated with the present invention is to provide systems for carrying out processes of the type disclosed by the invention, in particular aiming at recovering rare earth elements (REEs) and/or Lithium, optionally further of other elements, including potentially toxic elements (PTEs), and elements of the group of the Platine, from primary media provided in the form of saline aqueous media, by living marine macroalgae, with better efficiency of means used, including optimal quantities to be used, less construction complexity and smaller relative dimensions of the systems, in particular smaller area do system required.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
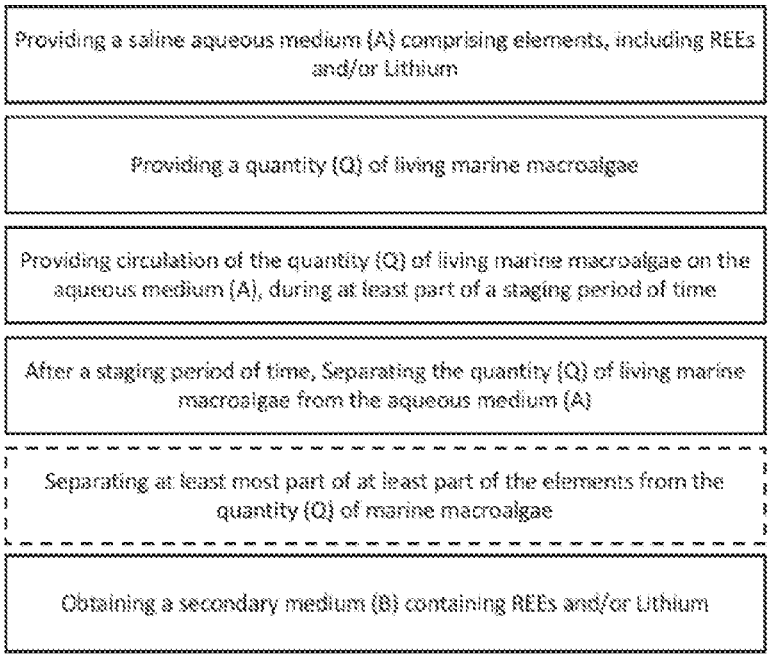
FIG. 1 is a flow diagram of a process according to the present invention, a phase of recovery of elements present in a saline aqueous medium by living marine macroalgae, and a phase of separation of elements from the macroalgae.

FIG. 1 represents the main steps of a process according to the present invention for recovering certain elements, including rare earth elements (REEs) and/or Lithium, from a saline aqueous medium containing said elements, such as for example an industrial effluent, or from a portion of a natural aquifer.

Said steps correspond to the use of a saline initial aqueous medium (A), with a pH bigger than 6, in particular with a pH bigger than 6 and smaller than 9, and at least partially fluid, presenting initial concentrations of a plurality of elements, including initial concentrations ($C_i$) of REEs and/or Lithium, and supply of at least one quantity (Q) of living marine macroalgae to said initial aqueous medium (A). It is advantageous when there is provided an active interaction of said living marine macroalgae with said aqueous medium (A), for example with support of fluid circulation means, hydraulic or other.

According to tests that have been carried out, one verifies that after a staging period of time, the living marine macroalgae recovered part of the elements from the initial aqueous medium ($A_I$), so that there results an operating aqueous medium ($A_F$) presenting concentrations ($C_f$) of REEs and/or Lithium smaller than the respective initial concentrations ($C_i$).

Said staging period of time can correspond to a period that is sufficient for the living marine macroalgae to recover at least most part, advantageously at least 70%, of at least part of the REEs and/or Lithium, eventually further of other elements, such as for example potentially toxic elements (PTEs), and elements from the group of the Platine, initially present in the initial aqueous medium ($A_I$).

It is of advantage when said staging period of time is monitored or previously defined according to the initial concentrations ($C_I$) of elements, so that the final concentrations ($C_F$) of at least part of said elements is smaller than the previously defined values.

It is of advantage when at least the final concentrations ($C_F$), that is, at the end of said staging period of time or before the discharge of said aqueous medium to a free aquifer, of PTEs such as for example lead, mercury and others, are smaller than the respectively minimum environmental compliance values applicable to the discharge of industrial effluents into free aquifer of public use.

The quantity (Q) of living marine macroalgae is separated from the operating aqueous medium ($A_F$) after a staging period of time. In this case, said aqueous medium (A) can be discharge to an aquifer of public use, or be recirculated to a second step of process including interaction with living marine macroalgae.

Figure 2:
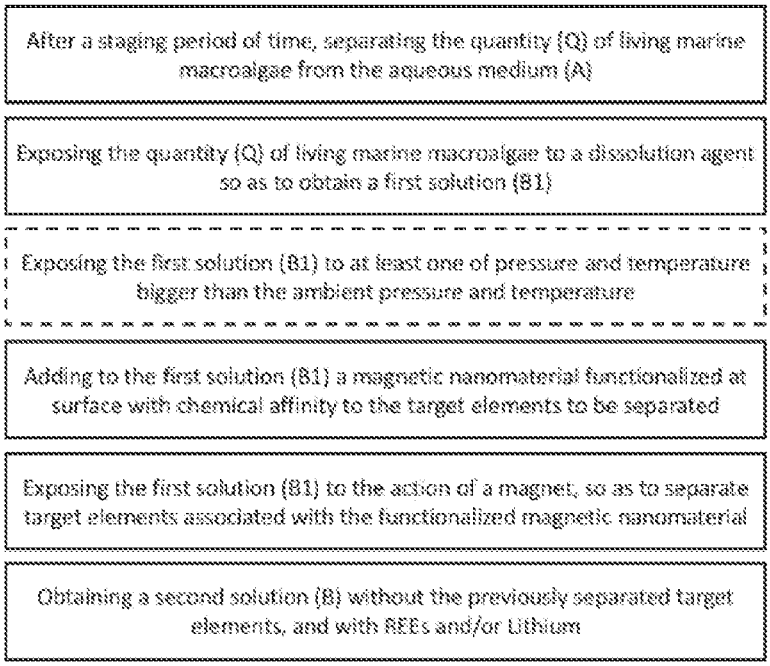
FIG. 2 is a flow diagram of an embodiment of a second phase of separation of elements from the macroalgae.

The quantity (Q) of living marine macroalgae can be additionally submitted to a second group of steps of process according to the present invention, so as to provide at least one of: separating at least part of the elements recovered, such as for example PTEs, and providing a medium mostly or only comprising specific elements with industrial reuse potential, including REEs and/or Lithium, corresponding to a secondary medium (B), as represented in particular in FIG. 2.

This second group of steps of the recovery process first includes the exposition of the quantity of living marine macroalgae to an acid agent for dissolution thereof, so that there is obtained a first solution including all the elements previously recovered from the aqueous medium (A).

Optionally, the first solution ($B_1$) can be exposed to an environment with at least one of pressure and temperature bigger than the ambient conditions.

In a next step, an advantageously magnetic nanomaterial, functionalized on the surface with groups with specific chemical affinity with the target element that are to be removed is added to said first solution. The solution is afterwards exposed to the action of a magnet, thereby removing the target elements associated with said functionalized nanomaterial and so that results a second solution that presents a bigger concentration of REEs and/or Lithium than other previously removed elements.

Figure 3:
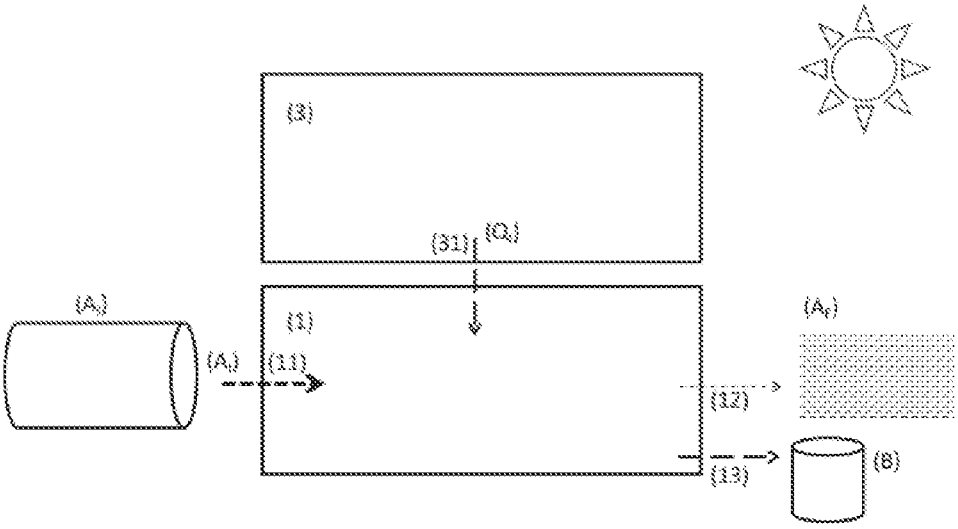
FIG. 3 is a diagram of a first embodiment of a system and process of recovery of REEs and/or Lithium from a primary medium.

FIG. 3 schematically represents an embodiment of systems and processes of recovery of REEs and/or Lithium from a primary medium (A), advantageously further of other elements, such as for example PTEs, and elements from the group of the Platine. Said primary medium (A) can be part of a free aquifer, such as for example a surface water line, or a residue or an effluent resulting from an industrial process and available in the form of a solid volume, of a liquid volume or of a volume of mud. In the case of a first embodiment of the process, said residue or effluent can be transported from an origin location, for example an industrial installation to a treatment system provided in situ. Alternatively, said volume of primary medium (A) can be transported to a recovery system ex situ relative to the location of origin.

In the case that the primary medium (A) is initially in the form of muds containing a relatively high concentration of Mercury, for example bigger than a environmental compliance value, then the process can include a step of drying the primary medium (A) by submitting it to a drying temperature of at least 100° C. and at most 400° C., during a period of up to 12 hours, advantageously of up to 6 horus.

In the case that the primary medium (A) is initially provided in the form of a substantially solid or mud medium, or similar, then the process can include a first step of adding a first aqueous volume to the primary medium (A) so as to obtain an initial aqueous medium ($A_I$) in an aqueous, substantially fluid form and presenting a pH bigger than 6, so that can be collected and processed in a first recovery disposition (1) of the recovery system.

In the case that said primary medium (A) is initially provided in a solid or mud state, or similar, the process according to the present invention can include supplying to said primary medium (A) at least one of: ultra-pure water, water, ammonium sulphate at 2%, ammonium acetate at 2%, ammonium dihydrogen phosphate at 2%, sodium hydroxide 1 mol $L^{-1}$, water acidified with nitric acid at 2% and water acidified with nitric acid at 10%.

Optionally, further in the case of the primary medium (A) is initially provided in the form of a solid, of a mud or similar, the process can further include the step of adding a first volume ($V_1$) of aqueous medium, in particular a volume of salted water, to said primary medium (A) so as to obtain an initial aqueous medium ($A_I$).

There can be provided a second aqueous volume ($V_2$), advantageously of salted water, to said initial aqueous medium ($A_I$), so as to obtain an aqueous volume ($V_A$) with a salinity comprised between 5 and 40, advantageously between 10 and 35.

In particular, the recovery process includes a plurality of successive cycles, each cycle including providing a quantity of the initial aqueous medium ($A_I$), in particular a quantity adapted to the collection volume of the first recovery disposition (1), and providing a quantity (QI) of living marine macroalgae, for example from a supply disposition (3) provided in optional fluid connection (31) with the first recovery disposition (1), so that these can interact with the initial aqueous medium ($A_I$), advantageously in an active interaction, that is, with active circulation of the living marine macroalgae in the aqueous medium (A), during a given staging period of time ($T_1$).

After conclusion of the staging period of time, the process can include the discharge of an operating aqueous medium ($A_F$) presenting a final concentration ($C_f$) of REEs and/or Lithium smaller than the initial concentration ($C_i$) of REEs and/or Lithium, out of the first recovery disposition (1), for example to a water body or to a free water line, and the retention of at least part of said quantity (QI) of living marine macroalgae in the first recovery disposition (1) so as to produce a second aqueous medium (B) therefrom, including the REEs and/or Lithium recovered by the living marine macroalgae.

Alternatively, the process can include the discharge of said quantity (QI) of living marine macroalgae from the first recovery disposition (1) for posterior processing of the second aqueous medium (B), and the supply of a second quantity (QII) of living marine macroalgae for interaction with said aqueous medium (A) on the first recovery disposition (1) during a second staging period of time ($T_2$).

Said reduction of the initial concentration ($C_i$) of REEs and/or Lithium can be bigger than 50%, advantageously bigger than 70%, in at least some of said REEs and/or Lithium, depending on the salinity of said aqueous medium being processed, as well as the type and quantity (QI) of living marine macroalgae used.

Figure 4:
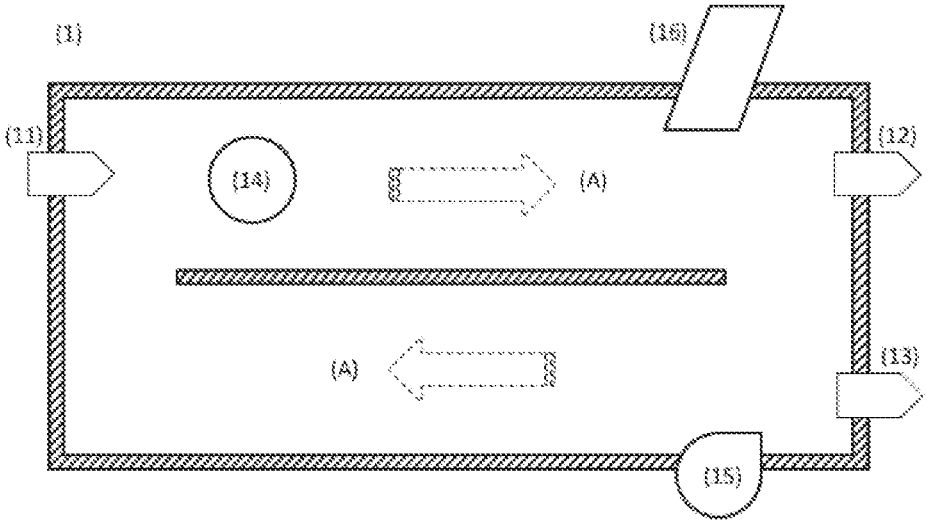
FIG. 4 is a diagram of an embodiment of a first recovery disposition (1) adapted so that provides interaction between an initial aqueous medium ($A_I$) and a quantity (Q) of living marine macroalgae.

In particular, as can be observed in FIG. 4, said first recovery disposition (1) can be provided with a closed fluid circulation route in a prevailing circulation direction. Moreover, the first recovery disposition (1) presents a feeder (11) of the initial aqueous medium ($A_I$) and a first discharge (12) provided in fluid connection with a water body or a free water line, such as for example an aquifer or the sea. The first recovery disposition (1) can further present a second discharge (13) that can be provided in fluid connection with collection recipients, for collection of said second aqueous medium (B) including the living marine macroalgae, after conclusion of the treatment of said primary aqueous (A).

Said first recovery disposition (1) can be provided as an open reservoir exposed to solar radiation, with a depth of up to 1 m and an inclined base region in the direction to at least one of said discharges.

It has been demonstrated as particularly advantageous when the interaction between the living marine macroalgae and the aqueous medium (A) unfolds in active manner, with provision of cinematic energy by additional means, including mechanical means of hydraulic impulsion (14), for example in the form of propellers, or similar, and/or gas flow injection means (15), for example of carbon dioxide.

Said quantity (QI) of living marine macroalgae can be previously determined according to at least one of: the quantity of the initial aqueous medium ($A_I$), the concentration of REEs and/or Lithium previously measured on said primary medium (A), or on said initial aqueous medium ($A_I$) provided therefrom.

Based upon several tests carried out by the Author, it has been shown as particularly advantageous to use a quantity (QI) of living marine macroalgae comprised between 2 g $L^{-1}$ and 25 g $L^{-1}$, advantageously between 2.5 g $L^{-1}$ and 20 g $L^{-1}$, and further advantageously between 3 and 15 g $L^{-1}$ of said initial aqueous medium ($A_I$).

Figure 5:
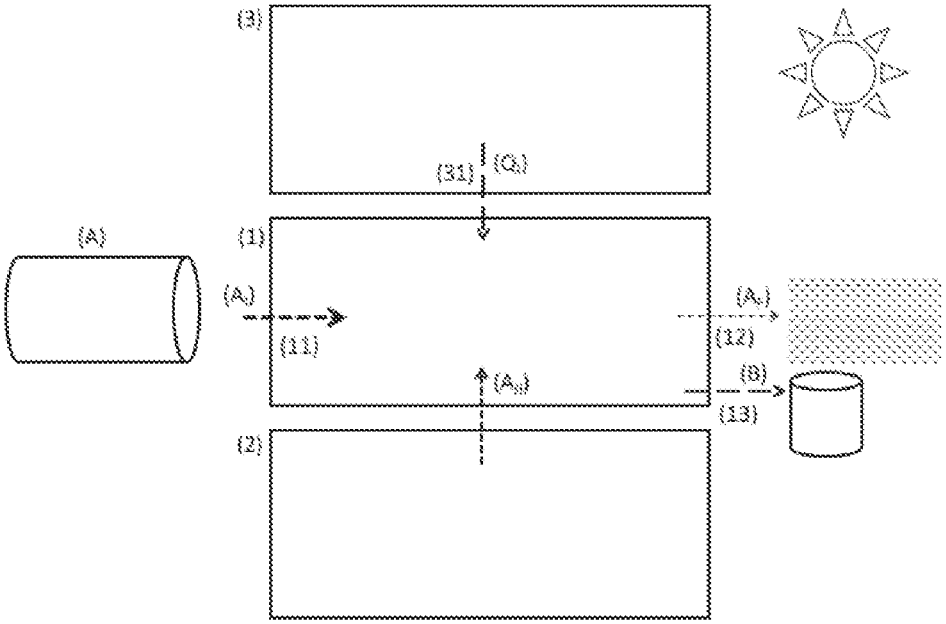
FIG. 5 is a diagram of a second embodiment of a system and a process according to the present invention.

FIG. 5 represents an embodiment of systems and processes according to the present invention, whereby there is provided a primary medium (A) in the form of muds from an industrial process. In this case, a quantity of said muds of primary medium (A) are mixed with a volume of aqueous medium ($A_{II}$), for example water, or salted water, so as to provide an initial aqueous medium ($A_I$) to a first recovery disposition (1).

Moreover, there is further supplied a first quantity (QI) of living marine macroalgae, for example supplied through an optional fluid connection (31) from a supply disposition (3) that can be part of an aquaculture of said living marine macroalgae, and without having been previously exposed to aqueous media with elevated concentration of REEs and/or Lithium.

The salinity and pH of said initial aqueous medium ($A_I$) can be further regulated by means of adding a second volume of aqueous medium ($A_{II}$), advantageously of salted water, such as for example sea water.

The evolution of the process of recovery of REEs and/or Lithium by the living marine macroalgae can be monitored by means of periodic measurement of a set of parameters, including the salinity and the concentrations of at least one of REEs, Lithium and PTEs, optionally further of other elements.

Figure 6:
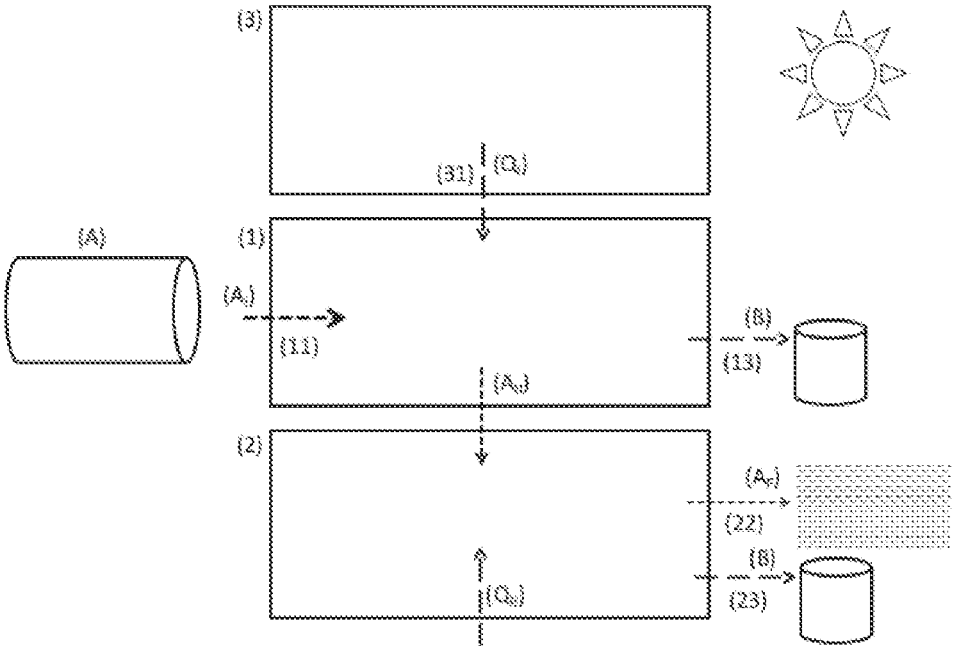
FIG. 6 is a diagram of a third embodiment of a system and a process according to the present invention.

FIG. 6 represents an embodiment whereby the initial aqueous medium ($A_I$), after a staging period of time of interaction with a first quantity (QI) of living marine macroalgae in a first recovery disposition (1), is discharged here from as second aqueous medium ($A_{II}$) to a second recovery disposition (2), advantageously with retention of said quantity (QI) of living marine macroalgae on said first recovery disposition (1).

Said first quantity (QI) of living marine macroalgae can be processed afterwards for obtaining a medium including REEs and/or Lithium and PTEs that have been recovered by the macroalgae.

A second quantity (QII) of living marine macroalgae at an initial stage of use, can be added to said second aqueous medium ($A_{II}$) and its interaction can be promoted during a second staging period of time.

This configuration results advantageous in providing a first and second levels of recovery of at least one of REEs, Lithium and PTEs from said primary medium (A) with a potentially shorter overall duration.

Figure 7:
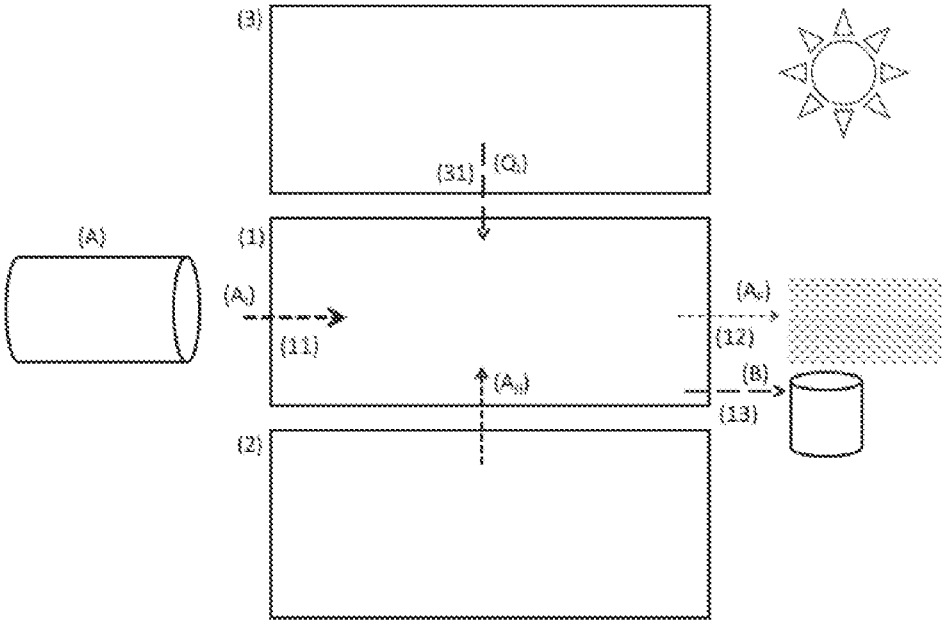
FIG. 7 is a diagram of a fourth embodiment of a system and a process according to the present invention.

FIG. 7 represents another embodiment of systems and processes of recovery according to the present invention, whereby there is provided an initial aqueous medium ($A_I$), a quantity (QI) of living marine macroalgae and, after a given staging period of time, there is supplied a volume of second aqueous medium ($A_{II}$), whereby said second aqueous medium ($A_{II}$) is advantageously a medium that has been previously object of a first processing with another quantity (QI) of living marine macroalgae, but that still presents relatively high concentrations of REEs and/or Lithium, and in particular relatively high concentrations of PTEs, for example concentrations above regulatory maximum values allowed for discharge of effluents to free water bodies.

Figure 8:
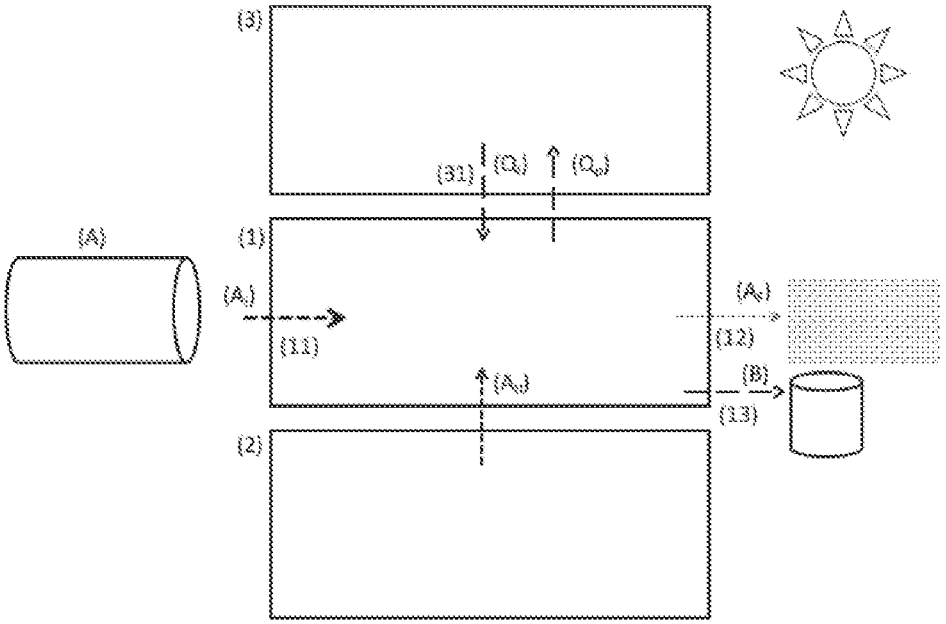
FIG. 8 is a diagram of a fifth embodiment of a system and a process according to the present invention.

FIG. 8 represents an embodiment of systems and processes according to the present invention, whereby an initial aqueous medium ($A_I$) and a first quantity (QI) of living marine macroalgae are initially provided to a first recovery disposition (1), whereby a part (Qp) of said first quantity (QI) of living marine macroalgae is thereafter periodically removed from said initial aqueous medium ($A_I$), in particular there is removed a part corresponding to said first quantity (QI) of living marine macroalgae.

It is of advantage when said recovery of part (Qp) of the first quantity (QI) of living marine macroalgae is carried out at least once a day and not more than six times a day.

According to another embodiment, there is removed a part (Qp) comprised between 5 and 50%, advantageously between 3 and 40% of the quantity of living marine macroalgae present in the first recovery disposition (1), thereby advantageously at least approximately the quantity of living marine macroalgae at the start of the operation cycle.

In this process, there can be supplied a second volume of aqueous medium ($A_{II}$), or of salted water.

In an embodiment (not represented), there can be periodically supplied a second quantity (QII) of living marine macroalgae, advantageously corresponding to a part (Qp) of the removed living marine macroalgae, advantageously from a collection disposition (3), adapted for supplying living marine macroalgae to the first recovery disposition (1).

Figure 9:
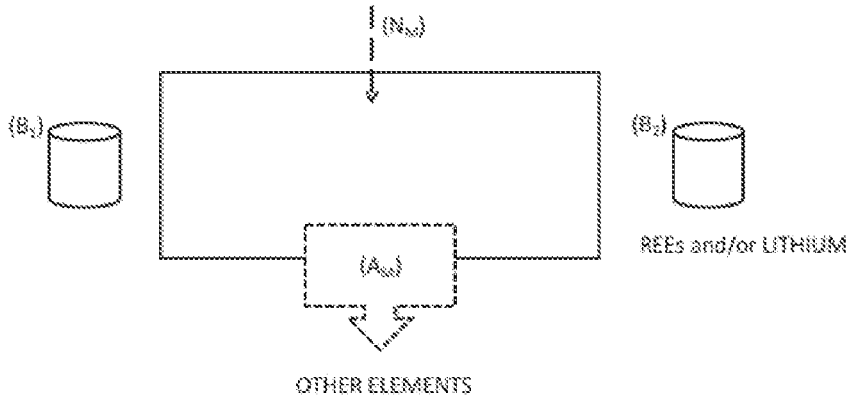
FIG. 9 is a diagram of an embodiment of separation of part of the elements from a first solution after dissolution of the marine macroalgae.

FIG. 9 schematically represents steps of an embodiment of providing a second medium ($B_1$) based upon the separation of elements, including of REEs and/or Lithium, previously recovered by said quantity (QI) of living marine macroalgae. In fact, the living marine macroalgae can recover a plurality of different elements present in the initial aqueous medium ($A_I$), including elements with different types of final disposal, such that it is therefore advantageous to carry out a separation of at least part of said elements.

In particular, this embodiment can include the separation of at least most part of the quantity of at least one group of elements, including at least one of REEs and/or Lithium, or further of PTEs, such as for example lead, mercury and other.

In particular, it is foreseen according to the present invention, providing a dissolution agent, including at least one of: acid agent, ultra-pure water, to the quantity (Q) of living marine macroalgae, thereby obtaining a first solution ($B_1$), optionally in an environment of pressure and temperature bigger than the ambient pressure and temperature, advantageously at a pressure of at least 1200 Psi, and temperature of at least 170° C.

Afterwards, it is foreseen adding to said first solution ($B_1$) a previously determined quantity of an advantageously magnetic nanomaterial ($N_M$), functionalized at surface with groups with chemical affinity with the target elements to be separated, providing interaction with the solution during a staging period of time, and advantageously exposing afterwards said first solution ($B_1$) to the action of a magnet ($A_M$), so as to separate at least one respective target element, such as for example elements that are not REEs and/or Lithium, from said first solution ($B_1$) thereby obtaining a second solution ($B_2$), including the REEs and/or Lithium, optionally others, devoid from the target elements previously separated from said first solution ($B_1$).

Besides of REEs and/or Lithium, the process according to the present invention can further provide the removal and separation of other elements, including elements of the group of the Platine that can be provided in a second solution ($B_2$) whereby they can represent the majority concentration of elements.

Alternatively, the second medium ($B_2$) can be provided based upon drying the quantity of macroalgae, incineration, combustion or pyrolysis thereof and separation of the several elements present in the ashes or chars resulting therefrom, including REEs and/or Lithium.

Figure 10:
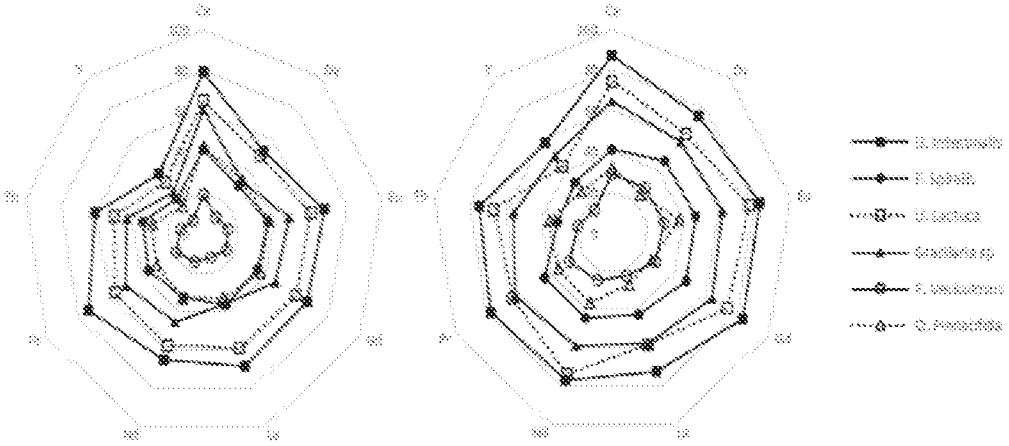
FIG. 10 is graphics of results of experiments with separation of a plurality of REEs by different types of living marine macroalgae, as a function of the salinity of the aqueous medium.
Figure 11:
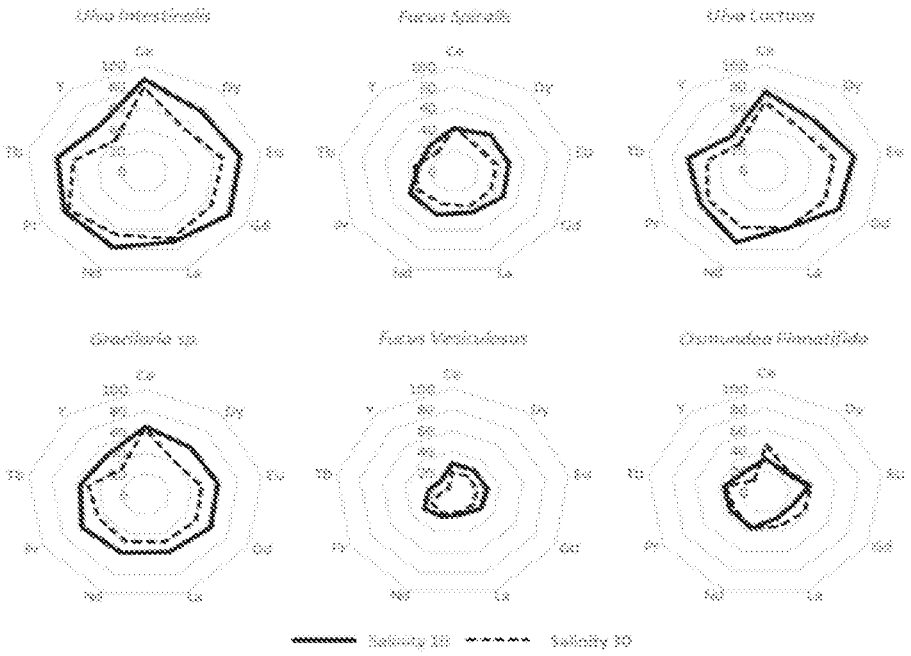
FIG. 11 is graphics of results of experiments with separation of a plurality of REEs by different types of living marine macroalgae, as a function of the type of macroalgae used.

FIGS. 10 and 11 show the results of tests conceived and carried out by the Author of the present invention, so as to determine the efficiency of recovery of different elements from the group of REEs by certain living marine macroalgae from a saline aqueous medium.

Said set of experiments was carried out for each one of the following species of marine macroalgae: *Ulva intestinalis, Fucus spiralis, Fucus vesiculosus, Ulva lactuca, Gracilaria* sp. and *Osmundea pinnatifida*. Each one of said species of marine macroalgae interacted with an aqueous medium ($A_I$) with similar concentrations of the following REEs: Ce, Dy, Eu, Gd, La, Nd, Pr, Tb e Y.

As can be observed in FIG. 10, the salinity of said initial aqueous medium ($A_I$) has influence in the recovery of REEs by the generality of species of marine macroalgae considered in these tests. In particular, it turns out as advantageous that the salinity of the aqueous medium ($A_I$) is comprised between 5 and 35.

It has been demonstrated as particularly advantageous when the initial aqueous medium ($A_I$) presents a salinity similar to the salinity of the medium of origin of the living marine macroalgae, whereby this can be the case that this of the sea or an aquaculture with marine water or similar hereto.

In this particular, it has been further demonstrated as particular advantageous when the salinity of the aquaculture of origin of the marine macroalgae and of said initial aqueous medium ($A_I$) is between 30 and 35.

As can be observed in FIG. 11, the marine macroalgae *Ulva intestinalis, Ulva lactucae Gracilaria* sp present the better rates of recovery of REEs.

In particular, there can be determined the use of at least two different species of said living marine macroalgae. advantageously based upon a first measurement of concentrations in the primary medium (A), so as to improve the combined result of recovery of REEs and/or Lithium, and/or so as to promote the advantageously removal of a given REEs and/or Lithium by a given species of marine macroalga.

Said first quantity (QI) of living marine macroalgae can advantageously include at least one of the following species of marine macroalgae: *F. vesiculosus* (Phaeophyta), *O. pinnatifida* (Rhodophyta), *Ulva Lactuca* (Chlorophyta), *Gracilaria* sp. (Rhodophyta) and *U. intestinalis* (Chlorophyta).

Moreover, it is of advantage when said first quantity (QI) of living marine macroalgae includes at least one of, advantageously at least two of: *Ulva Lactuca* (Chlorophyta), *Gracilaria* sp. (Rhodophyta) and *U. intestinalis* (Chlorophyta).

Figure 12:
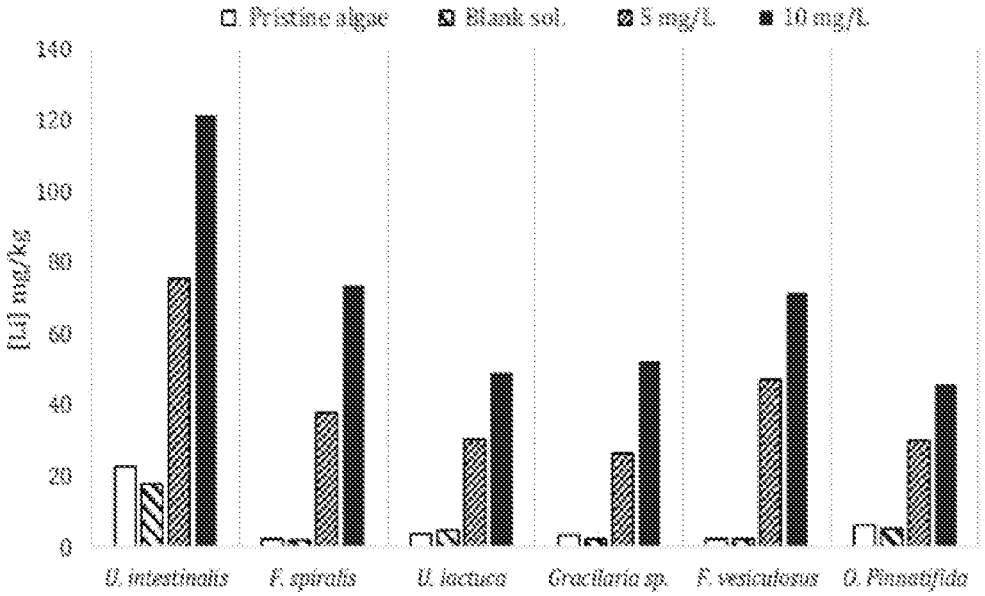
FIG. 12 is graphics of results of experiments with separation of Lithium by means of different types of living marine macroalgae, as a function of the type of marine macroalga and initial concentration of Lithium in the aqueous medium.

FIG. 12 shows the results of a sets of tests conceived and carried out by the author of the present invention, so as to determine what is the efficiency of recovery of Lithium by the living marine macroalgae from the saline aqueous medium.

Also in this case, said set of experiments was carried out for each one of the following species of marine macroalgae: *Ulva intestinalis, Fucus spiralis, Fucus vesiculosus, Ulva lactuca, Gracilaria* sp. and *Osmundea pinnatifida*. Each one of said species of marine macroalgae interacted with an initial aqueous medium ($A_I$) with two concentrations of Lithium: 5 and 10 mg/L. A "field algae" corresponds to algae collected directly from an ecosystem, whereas the "white sun" corresponds to algae kept in contact with sea water to which no Lithium has been added.

According to tests carried out and other known biophysical characteristics, it is of advantage when the living marine macroalga used in the process of recovery of REEs and/or Lithium according to the invention is the *Ulva lactuca*.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A process of recovery of rare earth elements (REEs) and/or Lithium from a primary medium, comprising:

providing an initial aqueous medium of the primary medium, presenting initial concentrations of at least REEs and/or Lithium and a pH bigger than 6, to a first recovery disposition;

providing at least a first quantity of living marine macroalgae, optionally further at least a second quantity of living marine macroalgae to the first recovery disposition so that the living marine macroalgae can actively interact with the initial aqueous medium during a staging period of time;

after the staging period of time, acquiring an operative aqueous medium presenting current concentrations of at least REEs and/or Lithium, smaller than the respective initial concentrations;

separating at least part of the first quantity of living marine macroalgae from the operative aqueous medium;

processing the separated quantity of living marine macroalgae so as to acquire a secondary medium that comprises quantities of REEs and/or Lithium at least similar to the respective quantities previously recovered by the living marine macroalgae from the initial aqueous medium, wherein said marine macroalgae comprises species of at least one of the following groups of marine macroalgae: Phaeophyta, Rhodophyta, Chlorophyta, wherein said first quantity of living marine macroalgae is determined based upon the initial concentrations of REEs and/or Lithium in said primary medium, wherein said first quantity of living marine macroalgae is provided according to a mass of living marine macroalgae at the upper region of the initial aqueous medium comprised between 8 and 12 kg/m$^2$ with relation to a top surface of the initial aqueous medium in the first recovery disposition and including a distribution of the living marine macroalgae up to 1 m depth thereof; and wherein the process, before interaction with living marine macroalgae, comprises providing a first aqueous volume to the primary medium so as to obtain the initial aqueous medium, and wherein said first aqueous volume is determined so that the initial aqueous medium presents a pH between 6 and 9, with a mass load of living marine macroalgae, with relation to the first quantity of living marine macroalgae, of at most 40 g L$^{-1}$, and so that the initial aqueous medium can be collected by the first recovery disposition.

2. The process according to claim 1, comprising:

a plurality of operation cycles, wherein in each operation cycle there is recovered a quantity of REEs and/or Lithium corresponding to at least 50% or to at least 70% of a respective initial concentration, at least one of the following steps before interaction with living marine macroalgae:

determining an initial concentration of elements comprising at least REEs and/or Lithium, present in the primary medium;

measuring an initial salinity of at least one of: the primary medium and the initial aqueous medium; and during the staging period of time determining the concentration of at least REE and/or Lithium, optionally of other elements including at least one of the group of PTEs, of said initial aqueous medium collected in the first recovery disposition in intervals of at least 24 hours, optionally in intervals of shorter duration, or at least until acquiring the operating aqueous medium.

3. The process according to claim 1, wherein the process further comprises the following steps:

in case the primary medium is initially in the form of muds comprising Mercury, heating the primary medium to a temperature of at least 100° C. and at most 400° C. during up to 6 hours or up to 12 hours;

in case the primary medium is initially in a solid state or of muds, supplying to said primary medium at least one of the following: ultra-pure water, water, ammonium sulphate at 2%, ammonium acetate at 2%, ammonium dihydrogen phosphate at 2%, sodium hydroxide 1 mol L$^{-1}$, acidified water with nitric acid at 2% and acidified water with nitric acid at 10%;

supplying a second volume of salted water as a second aqueous volume to said initial aqueous medium, so that the initial aqueous medium presents a salinity comprised between 5 and 40 or between 10 and 35;

wherein at least one of said first and second aqueous volumes is supplied from at least one of the following:

a second recovery disposition provided in fluid connection with the first recovery disposition, thereby providing for a reuse of the second aqueous volume processed in a previous operation cycle on the first recovery disposition;

a supply disposition provided in fluid connection with the first recovery disposition for supply of a quantity of living marine macroalgae to the first recovery disposition; and wherein the process further comprises at least one of the following steps:

discharging said operative aqueous medium together with at least part of said quantity of living marine macroalgae out of said first recovery disposition, and separating the operative aqueous medium and the living marine macroalgae, as well as separating the REEs and/or Lithium from said quantity of living marine macroalgae out of said first recovery disposition;

discharging at least part of said operative aqueous medium out of said first recovery disposition after said staging period of time to an aquifer or to a free water body.

4. The process according to claim 1, comprising at least one of the following steps:

selecting at least one species or at least two species from: Phaeophyta, Rhodophyta, Chlorophyta;

determining the first quantity of living marine macroalgae to be supplied to said first recovery disposition further based upon at least one of the following: the concentrations of REEs and/or Lithium and a salinity of said initial aqueous medium, wherein said first quantity of living marine macroalgae is determined at least in relation to the volume of said primary medium or in relation to a sum of the volume of said primary medium with other aqueous volumes, and wherein said first quantity of living marine macroalgae is provided according a mass of living marine macroalgae comprised between 8 and 20 $kg/m^3$ or between 10 and 15 $kg/m^3$ with relation to a volume of said initial aqueous medium.

5. The process according to claim 1, wherein said staging period of time is determined with relation to a supply of said quantity of living marine macroalgae according to at least one of the following:

a priori based upon at least one of the following: a volume of the initial aqueous medium and a quantity of the living marine macroalgae, wherein said staging period of time is of less than 72 hours or of less than 96 hours;

a posteriori based upon reaching at least one of the following:

a reduction by at least approximately a previously defined order of magnitude of a level of concentration of at least REE and/or Lithium, with relation to respective initial levels of concentration;

at least a pre-established concentration level of REEs and/or Lithium, smaller than respective initial concentration levels;

based upon periodic measurements of the concentration of REEs and/or Lithium, optionally further of a plurality of other elements.

6. The process according to claim 1, wherein the process further comprises at least one of the following:

removing at least part or at least most part of said first quantity of living marine macroalgae from said aqueous medium;

providing a second quantity of living marine macroalgae to said aqueous medium in said first recovery disposition, wherein said second quantity of living marine macroalgae is determined at least in relation to a volume of said primary medium;

maintaining at least part of the quantity of living marine macroalgae on said first recovery disposition, after the staging period of time and after discharge of said operating aqueous medium out of said first recovery disposition;

optionally, discharging the quantity of living marine macroalgae out of said first recovery disposition.

7. The process according to claim 1, wherein the process further comprises at least one of the following steps:

periodically removing part of said first quantity of living marine macroalgae from said aqueous medium for at least approximately resuming the quantity of macroalgae at the beginning of the operation cycle;

periodically supplying a second quantity of living marine macroalgae corresponding to the part of the removed living marine macroalgae from a supply disposition of living marine macroalgae.

8. The process according to claim 1, wherein during at least part of each operation cycle, the process further comprises at least one of the following steps:

providing said active interaction of the living marine macroalgae with the aqueous medium by means of at least one of the following:

a hydraulic impulsion unit, and an injection unit for injecting a gas flow into said aqueous medium in a prevailing circulation direction in closed circuit and so as to minimize the growth of microalgae;

providing a quantity of nutrients to said quantity of living marine macroalgae;

providing a gas flow atmospheric air or carbon dioxide to at least one of the following:

said aqueous medium;

a supply disposition;

providing aeration and luminous radiation to said first recovery disposition, and exposition to at least one of the following operation inputs:

natural light and/or artificial light for ensuring previously defined lighting levels during the night periods;

exterior environment and/or interior environment according to outside temperature so as to minimize temperature variations on the aqueous medium;

regulating each one of the operation inputs comprising movement and supply of gas flow to said aqueous medium.

9. The process according to claim 1, wherein said processing the quantity of living marine macroalgae, after said staging period of time and separation thereof from the operative aqueous medium so as to acquire a secondary medium, comprises:

providing an agent of dissolution, comprising at least one of: an acid agent at 2% or at 10%, to the quantity of marine macroalgae, thereby acquiring a first solution;

optionally, providing an ambient of pressure and temperature of at least 1200 psi and of at least 170° C.;

adding to the first solution a previously determined quantity of a magnetic nanomaterial functionalized at a surface with groups comprising a chemical affinity with target elements to be separated, providing an interaction within the solution during a staging period of time, and thereafter exposing the solution to the action of a magnet, so as to separate at least one target element, which is not REEs and/or Lithium, from said first solution, thereby acquiring said secondary medium in the form of a solution mostly comprising at least REEs and/or Lithium, and being devoid of the at least one target element removed from the first solution, optionally, separation of PTEs from said first solution, comprising at least one of: lead, mercury, chromium, nickel, copper, cadmium;

optionally, sorption of REEs and/or Lithium after acquiring a solution of REEs and/or Lithium, so that said secondary medium is provided in a solid mass;

optionally, separation of REEs from said first solution so as to acquire said secondary medium comprising at least REEs and/or Lithium.

10. The process according to claim 1, wherein said processing the quantity of living marine macroalgae, after said staging period of time and separation thereof from the operating aqueous medium so as to acquire a secondary medium, comprise:

optionally, drying said quantity of marine macroalgae;

incineration, including by combustion or pyrolysis, of said quantity of marine macroalgae so as to acquire ashes or chars, comprising at least REEs and/or Lithium.

11. The process according to claim 1, further comprising:

providing an aquaculture of marine macroalgae in an aquaculture disposition, provided in optional fluid connection with a supply disposition, wherein said aquaculture of marine macroalgae comprises species of at least one of the following groups of marine macroalgae: Phaeophyta, Rhodophyta, Chlorophyta;

optionally, from time to time measuring and regulating the salinity of the aqueous medium of said aquaculture of marine macroalgae.

* * * * *